United States Patent [19]

Leasure et al.

[11] 4,081,943

[45] Apr. 4, 1978

[54] APPARATUS AND METHOD FOR PRODUCING PACKAGES WITH INDIVIDUAL PRODUCT-FILLED CELLS

[75] Inventors: William C. Leasure; Luis Garcia, both of Houston, Tex.

[73] Assignee: Mira-Pak, Inc., Houston, Tex.

[21] Appl. No.: 764,090

[22] Filed: Jan. 31, 1977

[51] Int. Cl.[2] ..... B65b 9/12; B65B 17/02; B65B 35/40

[52] U.S. Cl. ..... 53/26; 53/28; 53/159; 53/182 M; 156/556; 156/578

[58] Field of Search ..... 53/3, 26, 28, 147, 159, 53/180 M, 182 M, 29, 383, 387, 196, 73; 156/556–559, 566, 578

[56] References Cited

U.S. PATENT DOCUMENTS

| | | | |
|---|---|---|---|
| 2,651,153 | 9/1953 | Burnett | 53/26 X |
| 2,907,153 | 10/1959 | Toles | 53/387 X |
| 3,322,323 | 5/1967 | Greene et al. | 206/813 X |
| 3,447,733 | 6/1969 | Smith | 229/15 X |
| 3,996,722 | 12/1976 | Bernhardt | 53/28 X |

*Primary Examiner*—Robert Louis Spruill
*Attorney, Agent, or Firm*—Larson, Taylor and Hinds

[57] ABSTRACT

Apparatus and method are provided for producing a package having a plurality of product-filled cells. The apparatus comprised a mechanism for producing a plurality of individual product-filled cells and for delivering the cells properly orientated. The apparatus further comprises a spraying mechanism for applying adhesive to the side of at least one of the individual cells and a mechanism for bringing the cells together into side-by-side contact with the adhesive-coated surface therebetween so as to bond the cells together to make a package. With certain adhesives, the cells can be removably attached together such that the package is severable into individual cells merely by pulling the cells apart along the bond. The method comprised the steps of producing the product-filled cells and applying adhesive to at least one of the cells. The method further comprises the steps of delivering the cells to guides and urging the cells along the guides until the cells are in side-by-side contact with the adhesive-coated surface therebetween, and then transferring the contacting cells to a holding station where the cells are held in side-by-side contacting relationship until the adhesive bonding of the cells has set.

10 Claims, 7 Drawing Figures

APPARATUS AND METHOD FOR PRODUCING PACKAGES WITH INDIVIDUAL PRODUCT-FILLED CELLS

BACKGROUND OF THE INVENTION

1. Field of the Invention

This invention relates to packaging apparatuses and methods, and more particularly to an apparatus and method for producing a package having a plurality of product-filled cells.

2. Description of the Prior Art

Various types of multi-cellular packages have been developed for merchandising products. Some consumer food products include for example; grains and cereals, noodles and the like, and snack foods such as potato chips, pretzels and the like. The economy results from the costs of handling a quantity of goods in a large number of individual packages being much greater than the costs for handling the same quantity of goods packaged in a smaller number of larger packages. On the other hand, the consumer would like to open and use only a portion of the product while keeping the remainder of the product sealed and fresh until it is needed. The use of multi-cellular packages provides the economies of scale of the convenience of stocking a large supply of the product without the risk of product spoilage that results from partially opened, larger packages, and the provisions of individual portions of the product which eliminates the need to wrap or repackage unused amounts.

Multi-cellular packaging can also be used for the packaging of a large number of complementary food samples. The package can be made having a plurality of cells with each cell containing a different type of food product thereby affording the consumer a greater variety.

The prior art multi-cellular packaging includes both separate, individual product-filled cells and individual cells affixed to a common backing card. The cells in both prior art arrangements are further encased in an outer shell. An important disadvantage in these particular packaging arrangements is that the individual cells are packaged in yet another bulky encasing large cell, which requires even more packaging material than if the cells were sold individually. Thus a need arises to conserve packaging material without eliminating the cost savings of buying in large quantities.

The elimination of the additional package material and associated bulkiness associated with the prior art packaging, would result in less space to transport the goods and less shelf space to display the goods, both conservations of space yielding cost savings.

SUMMARY OF THE INVENTION

The present invention provides for an apparatus and method for producing packaging having product-filled cells and overcomes the disadvantages associated with the prior art devices noted hereinbefore. More specifically, apparatus and method is provided for the production of multi-cellular packages that achieves the advantages associated with large volume sales while simultaneously reducing the quantity of packaging materials needed and affording savings on transportation and shelf space.

The individual cells of the packaging can be produced by any number of well known methods, including by the method and with the apparatus of the following United States Patents. U.S. Pat. Nos. 2,899,875 and 2,969,627 disclose formers adapted to shape strip packaging film into tubular configuration and to seal the ends of the tubular configuration. U.S. Pat. Nos. 3,543,467; 3,543,368; 3,543,477; 3,548,563; 3,552,081; and 3,785,112 disclose various methods and apparatuses for forming flat bottom packages and otherwise shaping and adding rigidity to packages made by the form, fill and seal packaging machinery disclosed in the '875 and '627 patents.

In accordance with a preferred embodiment of the invention, an apparatus is provided for producing packaging with individual product-filled cells. The apparatus comprises a supporting frame and a mechanism adapted to mount the frame for delivering a plurality of individual product-filled cells. The apparatus also includes a mechanism for applying adhesive to a portion of the outer surface of at least one of the individual cells, and a mechanism for bringing the cells into contact with the adhesive-coated surface therebetween so as to bond the cells together into a package.

A method is provided for producing a package having a plurality of product-filled cells comprising the steps of delivering a plurality of individual, properly orientated, product-filled cells; applying adhesive to a portion of the outer surface of a side of at least one of the cells; and urging the cells into side-by-side contact with the adhesive-coated surface therebetween so as to bond the cells together into a package.

Additional features and advantages of the invention will be set forth in, or apparent from, the detailed description of the preferred embodiments of the invention found hereinbelow.

DETAILED DESCRIPTION OF THE PREFERRED EMBODIMENTS

Figure 1B:
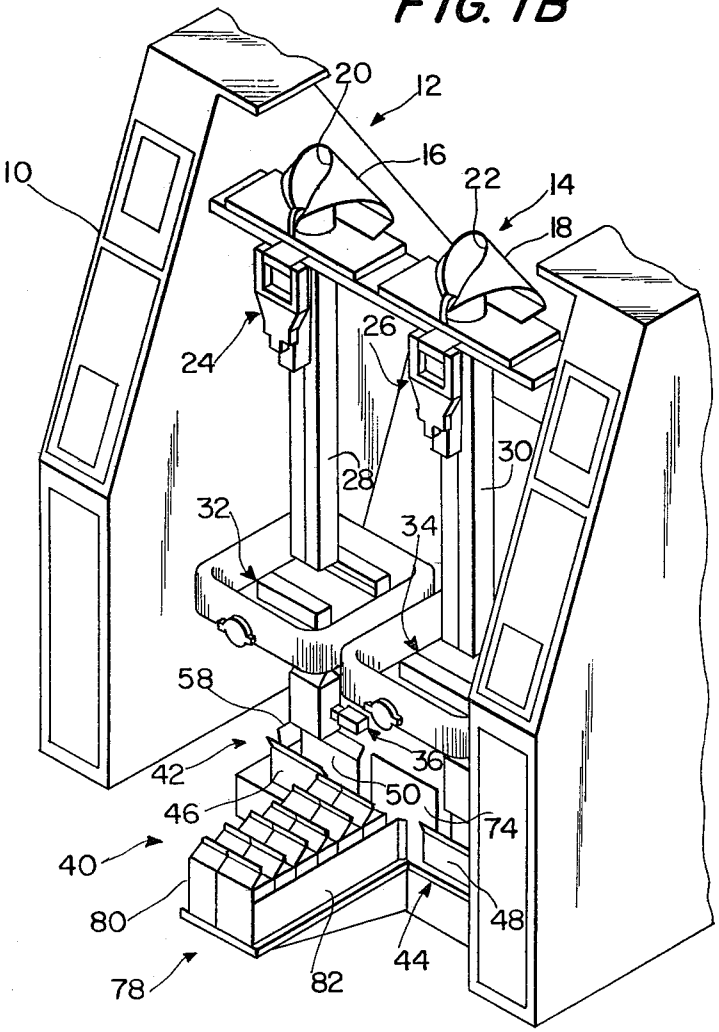
FIGS. 1A, 1B, 1C, 1D, and 1E are perspective views with certain elements removed for clarity of a packaging apparatus in accordance with the invention, each figure depicting the apparatus in progressive stages of operation.
Figure 1A:
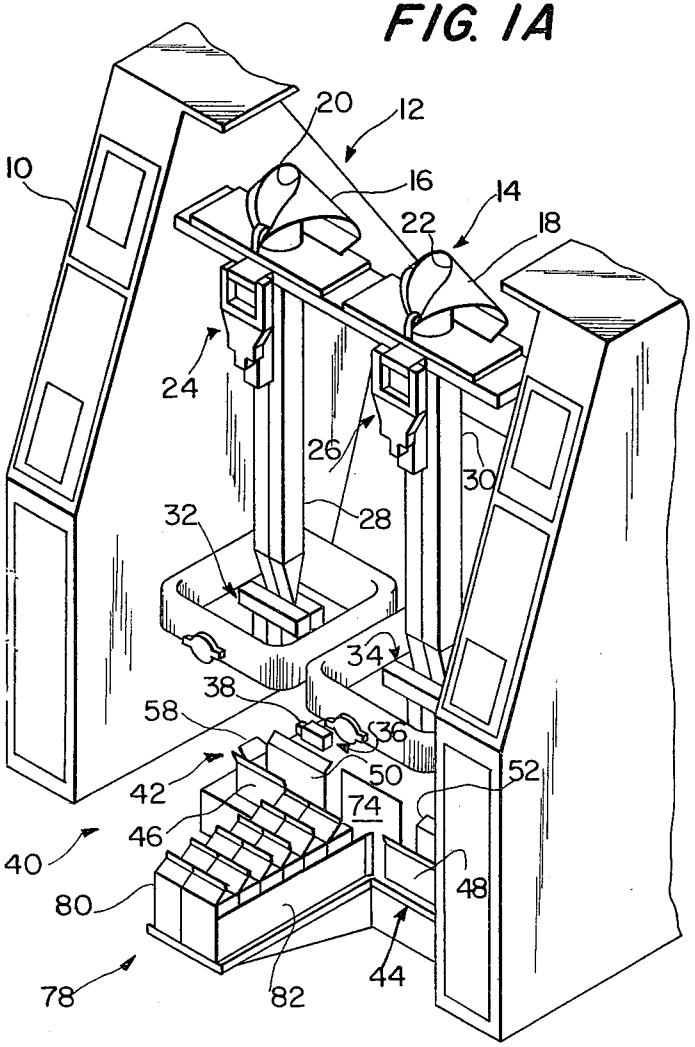

With reference to the figures, and, in particular, to FIG. 1A, there is disclosed a preferred embodiment of the packaging apparatus. The packaging apparatus includes a plurality of vertical formers in a side-by-side relationship, the number of formers being equal to the number of cells in the finished package. In the presently disclosed embodiment of the invention, only two formers, a first former 12 and a second former 14, are depicted although the invention should not be restricted to only two formers. Formers 12 and 14 can be constructed, for example, in accordance with the previously mentioned patents.

Formers 12 and 14 include shoes 16 and 18 respectively, each shoe having a port 20 and 22 respectively. Two strip packaging films, which can for example, be heat sealable, are respectively drawn over shoes 16 and 18 and downwardly through ports 20 and 22 to form elongate cells or tubes 28 and 30, having overlapping longitudinal edges.

Formers 12 and 14 further include sealing mechanisms 24 and 26 which can be constructed, for example, in accordance with U.S. Pat. No. 3,133,390 for sealing together the overlapping longitudinal edges of the strip packaging forming tubes 28 and 30.

The packaging apparatus further comprises sealing jaw pairs 32 and 34 which are mounted on frame 10. Jaws 32 and 34 include a sealing mechanism for making a transverse seal at the end of each newly formed tube 28 and 30 and a severing mechanism for severing the end of one tube from the next preceeding tube, thereby resulting in a conventional pillow package with a sealed top and bottom and longitudinal edge.

Figure 2:
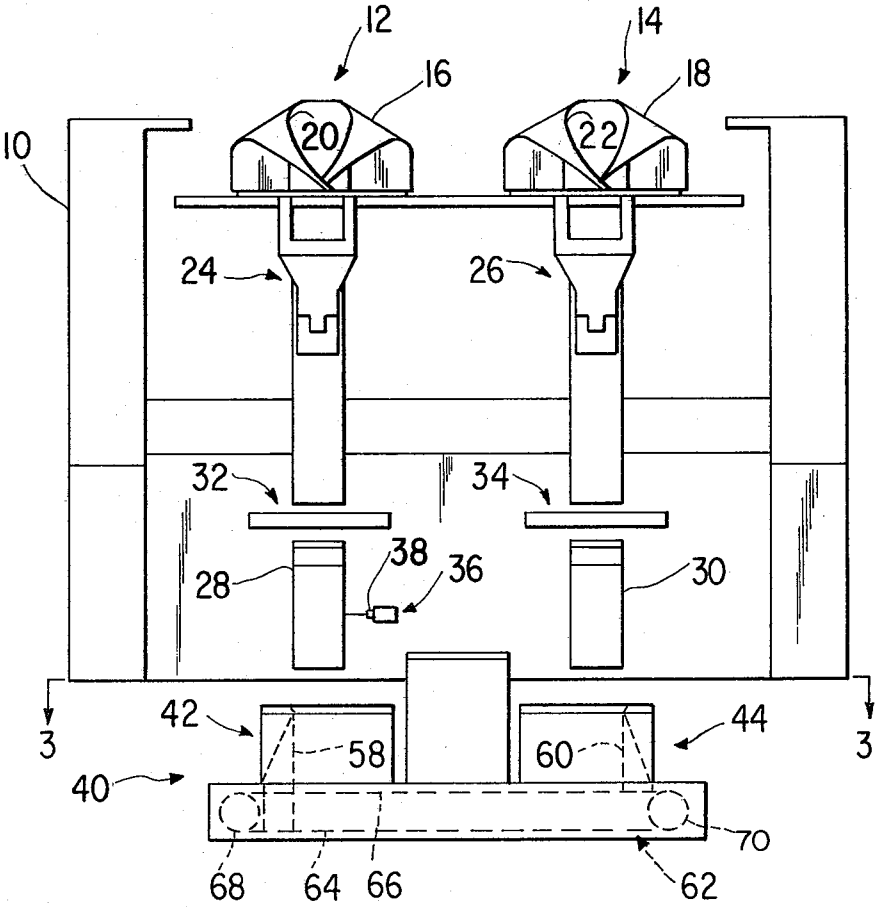
FIG. 2 is a schematic front elevational view of the packaging apparatus as depicted in FIG. 1B.

As depicted in FIGS. 1A, 1B and 2, the packaging apparatus further includes a spraying mechanism 36 mounted on frame 10, for applying adhesive onto the side of cells produced by former 12. Spraying mechanism 36 includes a nozzle and heating element 38 for ensuring the proper flow of adhesive from spraying mechanism 36.

Figure 3:
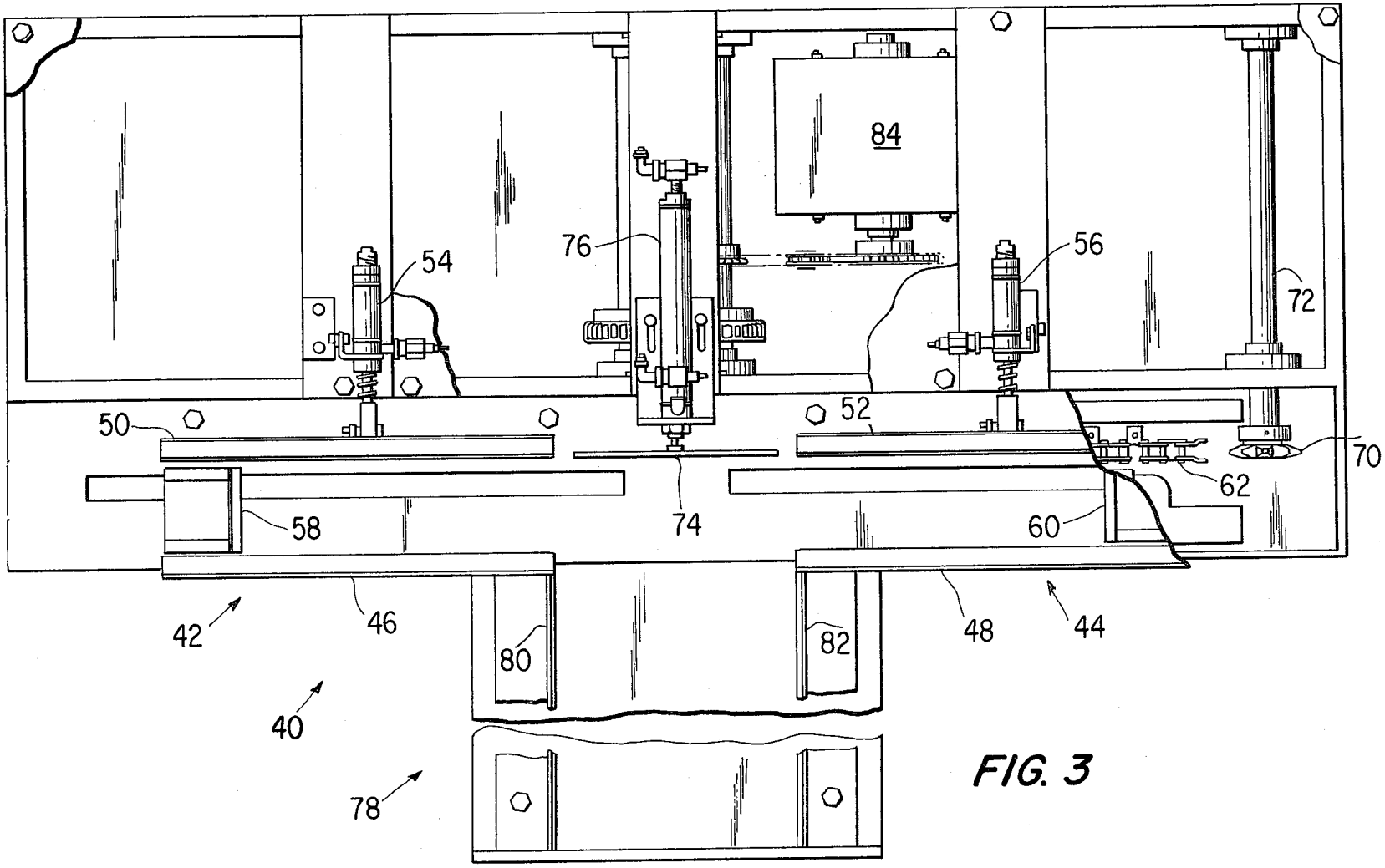
FIG. 3 is a cross-sectional, plan view taken along line 3—3 of FIG. 2.

Depicted in FIGS. 1A and 2 and in more detail in FIG. 3, is a cell assembly mechanism 40 for bringing the formed cells into side-by-side contact with the adhesive-coated surface of one cell therebetween so as to bond the cells together into a package. Cell assembly mechanism 40 includes a first guide 42 and second guide 44 in longitudinal alignment with first guide 42, each guide accepting a cell from the corresponding former for assembly by mechanism 40. The opposing ends of guides 42 and 44 are spaced apart at least a distance sufficient to allow two cells, in side-by-side relationship to pass therebetween along a path generally perpendicular to guides 42 and 44.

Guides 42 and 44 include stationary plates 46 and 48, respectively, that are rigidly mounted on frame 10. Plates 46 and 48 are generally planar and include an outwardly bent upper portion to facillitate unobstructed cell disposition into guides 42 and 44. Guides 42 and 44 further include pivotal plates 50 and 52 that are pivotally mounted along their lower edge to frame 10 and are spaced apart from stationary plates 46 and 48. Plates 50 and 52 are generally planar and include outwardly bent upper portions to facillitate unobstructed cell disposition.

As depicted in FIG. 3, pivotal plates 50 and 52 are pivotally secured to plungers of pneumatic cylinders 54 and 56, said cylinders being rigidly mounted to frame 10. Plungers of cylinders 54 and 56 pivot plates 50 and 52 form a closed mode, wherein said plates are generally vertical and parallel to the plane of stationary plates 46 and 48, to an open mode, wherein pivotal plates 50 and 52 are pivoted backwardly, forming acute angles with stationary plates 46 and 48.

Positioned between the plates of guides 42 and 44 are urging plates 58 and 60 (see FIGS. 2 and 3), said urging plates being slidably mounted on frame 10. The urging surface of each urging plate 58 and 60 is generally vertical and parallel to the other, and includes upper bent portions similar in function to the bent plate portions of guides 42 and 44. Further, each urging plate includes two triangularly-shaped reinforcing side wings or gussets.

Urging plates 58 and 60, as depicted in FIG. 2 are adapted to engage an endless drive chain 62 (shown by broken lines), plate 58 adapted to engage a lower portion of 64 of chain 62, and plate 60 adapted to engage an upper portion of 66 of chain 62. Chain 62 is rotably mounted at each end on and is driven by sprockets 68 and 70. When chain 62 is rotated in a counter-clockwise direction as shown in FIG. 2, urging plates 58 and 60 push corresponding cells which have been deposited in guides 42 and 44 toward each other. As chain 62 turns in a clockwise manner about supporting sprockets 68 and 70, urging plates 58 and 60 slide away from each other. Sprocket 70 is axially mounted on frame 10. A suitable motor mechanism not shown drivingly engages drive shaft 72.

Interposed between pivotal plates 50 and 52 of guides 42 and 44 is a transfer plate 74 (FIGS. 1A, and 3) that is slidably mounted to frame 10. Transfer plate 74 is generally vertical and parallel to the plane of pivotal plates 50 and 52, when said plates are in the closed mode. One end of a plunger of a pneumatic cylinder 76 (FIG. 3) is mounted to transfer plate 74. By the selective addition of air to cylinder 76, transfer plate 74 can be reciprocated from a position between pivotal plates 50 and 52 to a position between stationary plates 46 and 48, thereby transferring the cells which have been previously urged together between urging plates 58 and 60 to a holding station 78. The selective addition of air to the pneumatic cylinders 54, 56, and 76, and thus motion of pivotal plates 50 and 52 and transfer plate 74 is controlled by a conventional timing mechanism 84. Mechanism 84 can include, for example, a cam and switch device.

Holding station 78 (FIGS. 1A and 3) includes first and second parallel plates 80 and 82, which are rigidly attached to frame 10. Plates 80 and 82 hold the assembled packages in an abutting side-by-side relationship until the adhesive is cured. As can best be seen in FIG. 1A, the leading vertical edges are located adjacent guides 42 and 44 and parallel plates 80 and 82 are bent longitudinally outwardly thereby forming a larger receiving area for facillitating unobstructed acceptance of the assembled packages transferred by transfer plate 74.

The operation of the packaging apparatus is as follows. Strip packaging film is initially threaded into position in the packaging apparatus by feeding the film over the surface shoes 16 and 18 of formers 12 and 14, respectively, by for example a workman, thereafter the film is initially drawn downwardly through ports 20 and 22, to form the first elongate cells or tubes 28 and 30, the longitudinal edges of the strip packaging film overlapping. The longitudinal edges of the strip packaging film are then sealed together by seal mechanisms 24 and 26.

The workman engages the lowermost ends of elongate cells 28 and 30 between sealing jaw pairs 32 and 34 which are then closed and thus, seal the ends. The operating of the packaging apparatus then proceeds automatically in a conventional manner as the drawing of the film downwardly through ports 20 and 22 is then accomplished by the relative upward movement of formers 12 and 14, with respect to sealing jaws 32 and 34. As the film is drawn through ports 20 and 22, product (not shown) such as, for example, grains or cereals, can be deposited through the aforementioned ports into elongate cells 28 and 30. Once elongate cells 28 and 30 have been filled, jaw pairs 32 and 34 open, (FIG. 1B) allowing filled cells 28 and 30 to progress downwardly therethrough as formers 12 and 14 move downwardly toward said jaws. As the cells pass through jaws 32 and 34, adhesive is sprayed from sprayer 36 onto a portion of the side of one cell, said side being directly opposite the other simultaneously-formed cell. Jaws 32 and 34 then close on the filled cells directly above, and sever the filled cells from the partially formed cells.

As the cells proceed downwardly toward guides 42 and 44, additional adheshive is sprayed on the as yet uncoated portion of the aforementioned cell. (See FIG. 1B). Preparatory to receiving the cells, the pivot plates 50 and 52 are pivoted to the open mode and guides 42 and 44 are in condition to receive the cells. The cells are deposited downwardly between the plates of the guides, and the pivot plates 50 and 52 are then pivoted to the closed mode so as to retain the semi-rigid packages in the proper orientation (See FIG. 1C).

Figure 1D:
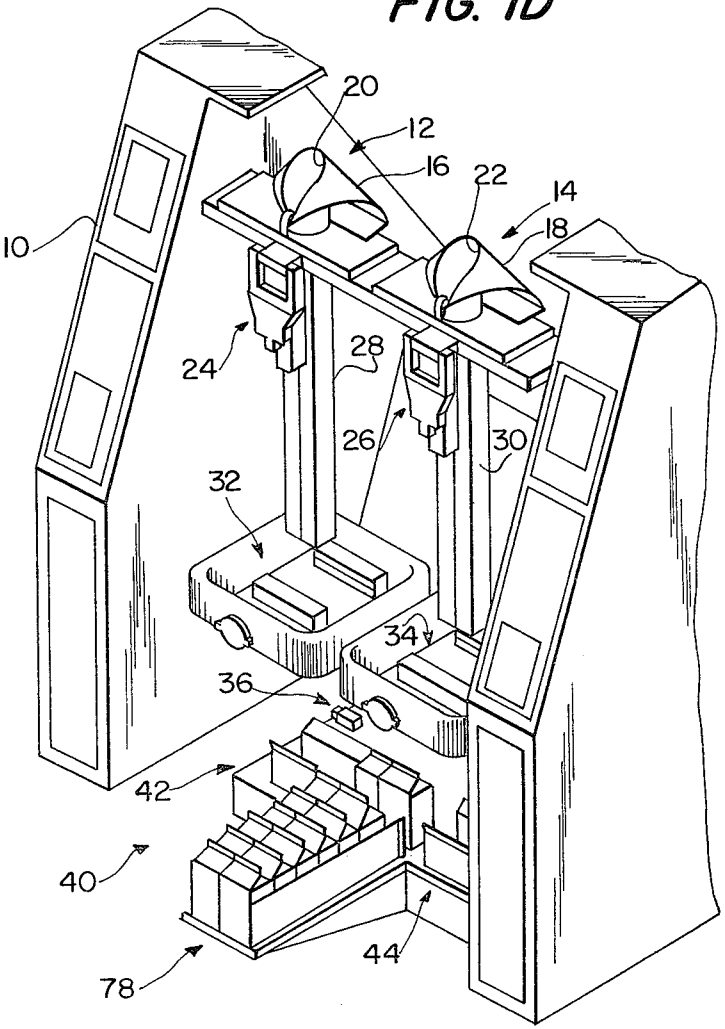
Figure 1C:
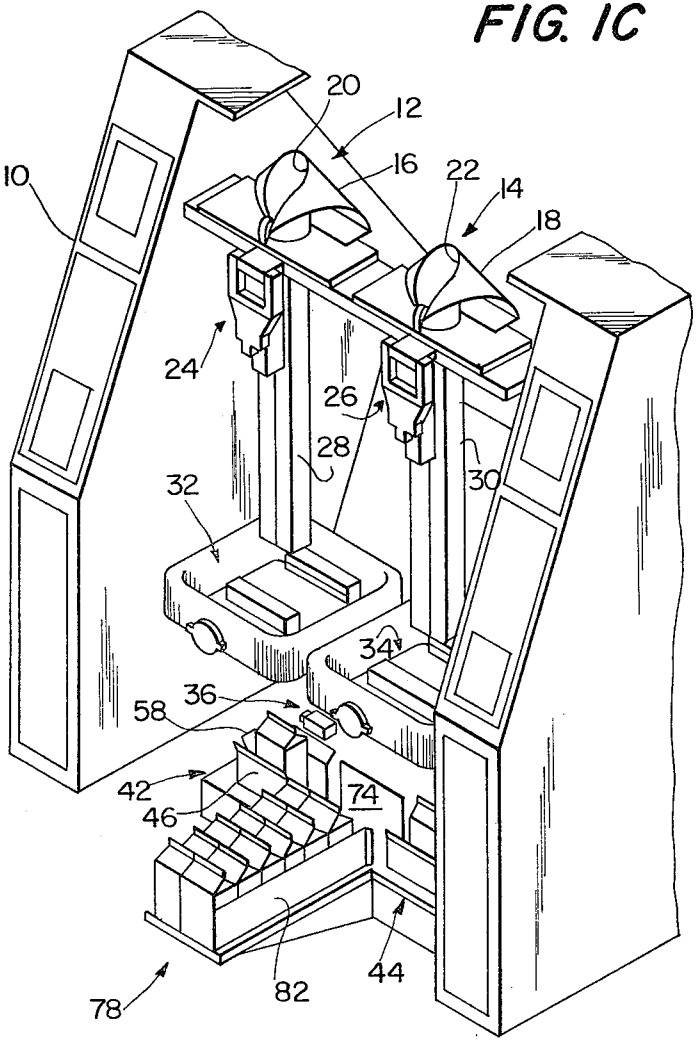

At this point, drive shaft 72 is rotated and it begins to turn drive chain 62 in a counter-clockwise direction, thus moving urging plates 58 and 60 toward each other and simultaneously urging their respective cells together into a side-by-side relationship with the adhesive-coated surface of one cell therebetween (see FIG. 1D.)

Figure 1E:
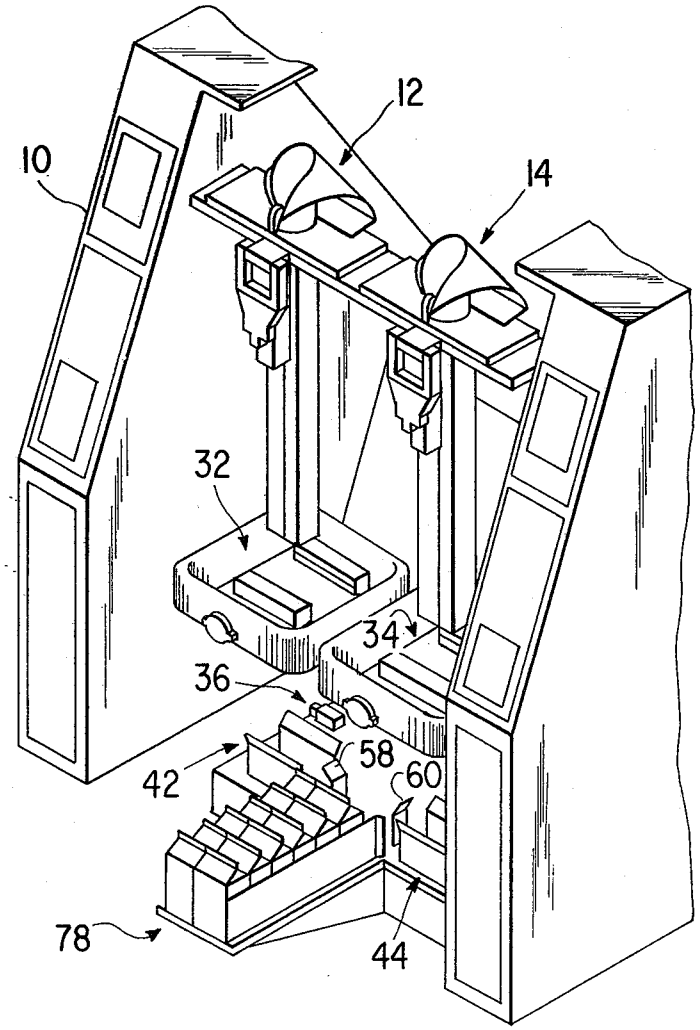

Transfer plate 74 is then actuated and engages the contacting side-by-side cells, continued movement of transfer plate 74 urges said cells between parallel plates 80 and 82 of holding station 78 (FIG. 1E). The side-by-side relationship of the assembled package of cells is maintained in holding station 78 until the adhesive has cured. Transfer plate 74 and urging plates 58 and 60 then return to their original positions (FIG. 1A) preparatory to the deposition of the next cells between guides 42 and 44. The previously formed package of two cells is advanced in a transversely outward direction along parallel plates 80 and 82 by subsequently formed packages as these packages are pushed between parallel plates 80 and 82 by transfer plate 74.

In an alternate embodiment, the formers can be rigidly mounted to the frame and the sealing jaws can be adopted to mount the frame so that said jaws reciprocate vertically with respect to the formers, thereby drawing the strip packaging film through the formers.

Additionally, in a further alternate embodiment, it should be understood that three or more cells can be assembled into a side-by-side multi-cellular package. In this embodiment, three formers or more with associated sealing jaws are provided for the formation of the cells. Spraying means are provided for spraying adhesive on the appropriate surfaces of the cells. The cells then can be allowed to proceed to a position between the guides as previously discussed. There would be no need for additional guides, as the guide could be lengthened so as to handle two or more cells each. Additionally, the space between the parallel plates of the holding station are appropriately increased to accommodate the increased package size.

Although the present invention has been described relative to an exemplary embodiment thereof, it will be understood by those skilled in the art that variations and modifications can be effected in these embodiments without departing from the scope and spirit of the invention.

I claim:

1. Packaging apparatus for producing a package having a plurality of product-filled cells comprising;

a supporting frame;

a plurality of formers mounted on said frame for shaping strip packaging material into tubular form;

a plurality of sealing jaw pairs mounted on said supporting frame, one pair associated with each former, for sealing the ends of each tubular form;

means for severing a filled and sealed cell from the tubular formed packaging material so as to make a closed product-filled cell;

means for applying adhesive to a portion of the outer surface of at least one of the individual cells, said adhesive applying means being mounted on said frame;

and means for bringing the cells into contact with the adhesvie coated surface therebetween thereby severably bonding the cells together into a package such that the package can be severable into individual cells by pulling the cells apart along the bond.

2. Packaging apparatus in accordance with Claim 1 wherein said formers are mounted on said frame in a parallel and vertical orientation with respect to each other, said jaw pairs positioned directly below each former so that the individual product-filled cells exit from said producing means in a parallel and vertical orientation with respect to each other.

3. Packaging apparatus for producing a package having a plurality of product-filled cells comprising:

a supporting frame;

means for forming a plurality of individual product-filled cells;

means for applying an adhesive to a portion of the side of at least one of the cells;

guide means for bringing the cells into a side-by-side contact with the adhesive-coated surface therebetween so as to bond the cells together into a package;

said guide means including a first and second pair of juxtaposed surfaces, at least one cell being received between each of said pairs of surfaces and urging means including juxtaposed planar surfaces slidably mounted on said frame, one said urging means surface being between said pairs of surfaces of said guide means.

4. Packaging apparatus in accordance with claim 3 wherein one surface of each pair of surfaces and said guide means is rigidly affixed to said frame, and the other of said surfaces is pivotally mounted to said frame, said guide means further including means for pivotally displacing said pivotally mounted surface between an open and a closed mode; said first pair of surfaces and said guide means spaced apart from second pair, the rigidly-affixed surface of said first pair being coplanar with a plane extending from the rigidly-affixed surface of said second pair; said pivotal surfaces pivoted to the closed mode after product-filled cells have been received between said surfaces of said guide means; and wherein said surfaces and said urging means are slidable between a cell-receiving mode and a cell-discharging mode for discharging the cells into the space between the first pair and said second pair of surfaces of said guide means.

5. Packaging apparatus in accordance with claim 4 wherein said first pair of surfaces of said guide means is at least sufficiently spaced apart from said second pair to allow two cells, positioned side by side, to pass therebetween along a direction perpendicular to the plane of said rigidly-affixed surfaces of said guide means.

6. Packaging apparatus in accordance with claim 3 wherein said urging means includes chain means, for slidably positioning said planar surfaces, said chain means mounted to said frame and having a first portion adapted to engage one of said slidable surfaces, and said chain means having a second portion adapted to engage the other of said slidable surfaces, so that the movement of the chain means in a forward direction urges the slidable surfaces toward each other and the movement in a reverse direction urges the slidable surfaces away from each other.

7. Packaging apparatus in accordance with claim 3 wherein said apparatus includes holding means for holding contacting cells together while the adhesive is drying, said apparatus further including transfer means for transferring the contacting cells from said urging means to said holding means.

8. Packaging apparatus in accordance with claim 7 wherein said holding means include two generally parallel retaining plates, spaced apart at least sufficiently to accept two cells in a contacting, side-by-side relationship and wherein said transfer means includes a plate slidably mounted to said frame so as to be slidable between said slidable surfaces of said urging means.

9. A method of producing a package including a plurality of product-filled cells comprising the steps of;

forming, filling, and sealing at least a pair of individual product filled cells while maintaining said cells in side by side relation, applying adhesive to one side of at least one of said sealed product filled cells, urging the cells into side by side contact with the adhesive coated surface therebetween so as to bond the cells together into a package.

10. A method of producing a package according to claim 9 including the further step of transferring the contacting cells to a holding station and holding the cells while they are in contacting side by side relationship until the adhesive bonding has set.

* * * * *